US008596910B2

(12) United States Patent
Semotiuk et al.

(10) Patent No.: US 8,596,910 B2
(45) Date of Patent: Dec. 3, 2013

(54) ENVIRONMENTAL CULVERT SYSTEM

(75) Inventors: Robert A. Semotiuk, Prince George (CA); Barbara Semotiuk, legal representative, Prince George (CA); Ronald W. Hammerstedt, McBridge (CA); Michael D. Rae, Campbell River (CA)

(73) Assignees: Robert A. Semotiuk, Prince George (CA); Ronald W. Hammerstedt, McBride (CA); Michael D. Rae, Campbell River (CA)

( * ) Notice: Subject to any disclaimer, the term of this patent is extended or adjusted under 35 U.S.C. 154(b) by 127 days.

(21) Appl. No.: 12/529,168

(22) PCT Filed: Feb. 27, 2008

(86) PCT No.: PCT/CA2008/000382

§ 371 (c)(1),
(2), (4) Date: May 7, 2010

(87) PCT Pub. No.: WO2008/104075

PCT Pub. Date: Sep. 4, 2008

(65) Prior Publication Data

US 2011/0150574 A1 Jun. 23, 2011

Related U.S. Application Data

(60) Provisional application No. 60/892,298, filed on Mar. 1, 2007.

(51) Int. Cl.
*E01F 5/00* (2006.01)

(52) U.S. Cl.
USPC ..... 405/126

(58) Field of Classification Search
USPC ..... 405/36, 38, 43–49, 124, 126; 52/86; 14/24, 26
See application file for complete search history.

(56) References Cited

U.S. PATENT DOCUMENTS

| | | | | | |
|---|---|---|---|---|---|
| 985,539 | A * | 2/1911 | Ottney | 138/162 |
| 2,126,091 | A * | 8/1938 | Claybaugh | 405/124 |
| 2,343,029 | A * | 2/1944 | Schmidt et al. | 138/106 |
| 4,245,924 | A | 1/1981 | Fouss | |
| 4,360,042 | A | 11/1982 | Fouss | |
| 4,983,070 | A * | 1/1991 | Hwang | 405/124 |
| 5,611,178 | A * | 3/1997 | Aubert | 52/169.6 |
| 5,669,733 | A * | 9/1997 | Daly et al. | 405/48 |
| 6,474,907 | B2 * | 11/2002 | Semotiuk et al. | 405/126 |

FOREIGN PATENT DOCUMENTS

CA 2225729 A1 * 6/1999

* cited by examiner

*Primary Examiner* — Sunil Singh
(74) *Attorney, Agent, or Firm* — Oyen Wiggs Green & Mutala LLP

(57) ABSTRACT

This invention relates to a novel environmentally compatible culvert system. More particularly, this invention relates to a novel multi-component modular environmental culvert system which is constructed of reaction injection molded components, comprising modular interconnecting bases, modular interconnecting corrugated arch systems, and modular joining binders. A modular culvert system comprising: (a) at least one base grid module; (b) at least one corrugated arch module resting on the grid; and (c) an arch shaped binder module adjacent the arch module.

7 Claims, 12 Drawing Sheets

ENVIRONMENTAL CULVERT SYSTEM

FIELD OF THE INVENTION

This invention relates to a novel environmentally compatible culvert system. More particularly, this invention relates to a novel multi-component modular environmental culvert system which is constructed of reaction injection molded components, comprising modular interconnecting bases, modular interconnecting corrugated arches, and modular intermediate joining binders.

BACKGROUND OF THE INVENTION

With increasing emphasis by regulatory authorities on minimizing damage to the environment, many jurisdictions have passed laws and regulations which prohibit the installation of materials which are regarded as being potentially harmful to the environment. Once such area is metal culvert replacement in road and bridge systems. In many jurisdictions, it is prohibited to replace existing corroded metal culverts with new metal culverts, even galvanized steel culverts. There is a need for an inexpensive, readily installable environmentally compatible culvert system that can be used for construction of new culverts and replacement of old culverts.

The foregoing examples of the related art and limitations related thereto are intended to be illustrative and not exclusive. Other limitations of the related art will become apparent to those of skill in the art upon a reading of the specification and a study of the drawings.

SUMMARY OF THE INVENTION

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

The invention is directed to a culvert system comprising: (a) at least one base grid module; (b) at least one corrugated arch module resting on the grid module; and (c) an arched binder module located adjacent the corrugated arch module.

The base grid module can comprise a plurality of interconnecting ribs with spaces therebetween and corrugated arch module receiving rails on each side thereof. The base grid module can include spatial openings therein for receiving the ends of the corrugated arch module.

The depths of the grooves of the corrugations in the corrugated arch module can deepen as the arch extends from the top center to each side at the base of the arch module. The lower edges of the arch module can have a series of protrusions thereon which can be adapted to fit into spatial openings in the base grid module.

There can be at least two adjacent arch modules and the arched binder can be adapted to fit between the adjacent arch modules, the binder having at the lower base thereof protrusions which fit into corresponding openings in the base grid module.

The arched binder can have a T-shaped cross-section. The corrugated arch receiving rails can have a hollow semi-cylindrical configuration. The corrugated arches can be formed in the shape of a hollow half cylinder.

There can be at least three base grid modules adjacent one another, at least two corrugated arch modules adjacent one another and offset 50 percent from the three base grid modules, and the arched binder fits between the two adjacent arch modules and releasably connects them together.

In addition to the exemplary aspects and embodiments described above, further aspects and embodiments will become apparent by reference to the drawings and by study of the following detailed descriptions.

BRIEF DESCRIPTION OF DRAWINGS

Exemplary embodiments are illustrated in referenced figures of the drawings. It is intended that the embodiments and figures disclosed herein are to be considered illustrative rather than restrictive.

DETAILED DESCRIPTION OF THE INVENTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

Figure 1:
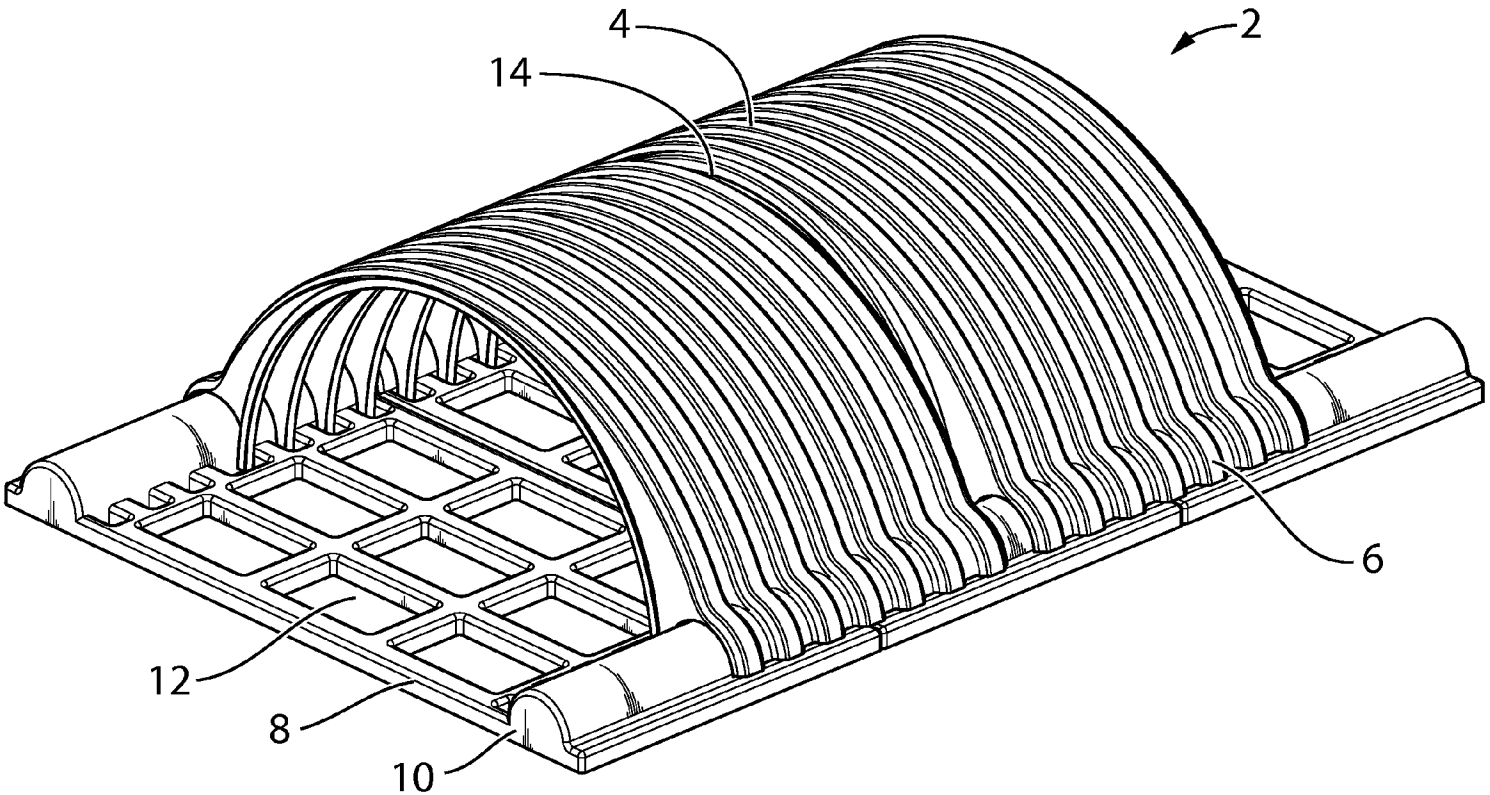
FIG. 1 illustrates an isometric view of the environmentally compatible modular culvert system according to the invention.

Referring to FIG. 1, which illustrates an isometric view of the modular culvert system 2, the modular culvert system as seen in FIG. 1 comprises two adjoining corrugated arch modules 4, which by means of respective cylindrical base grips 6 on each side, rest on three adjoining base modules 8. The three adjoining base modules 8 have on each side thereof adjoining cylindrical rails 10, which together support the cylindrical base grips 6 of the two adjoining overhead corrugated arch modules 4. The interior body of the base modules 8 have openings 12 which are arranged in a grid-like pattern. The two adjoining corrugated arch modules 4 are connected together by an arched binder 14.

It will be understood that the construction shown in FIG. 1 and subsequent figures is illustrative and that any number of arch modules, base modules and binders can be connected together to construct a culvert that is required in the field. In practice, the culverts can be short, medium or long in length, and in certain cases, can be linear or curved.

Figure 2:
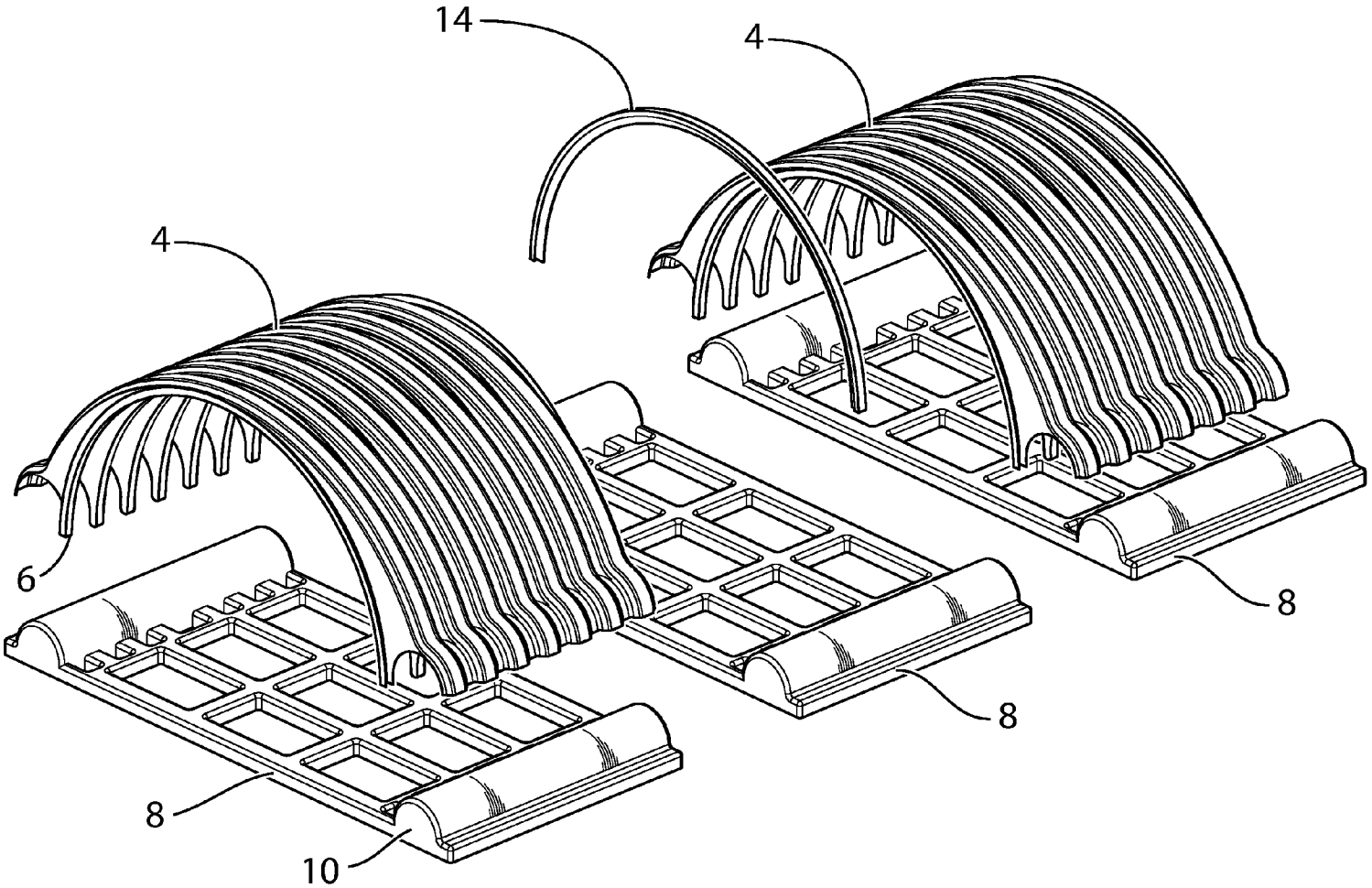
FIG. 2 illustrates an exploded isometric view of the environmentally compatible modular culvert system.

Referring to FIG. 2, which illustrates an exploded isometric view of the environmentally compatible modular culvert system, the two arch modules 4, the interconnecting binder 14 and the three base modules 8 are readily visible.

Figure 3:
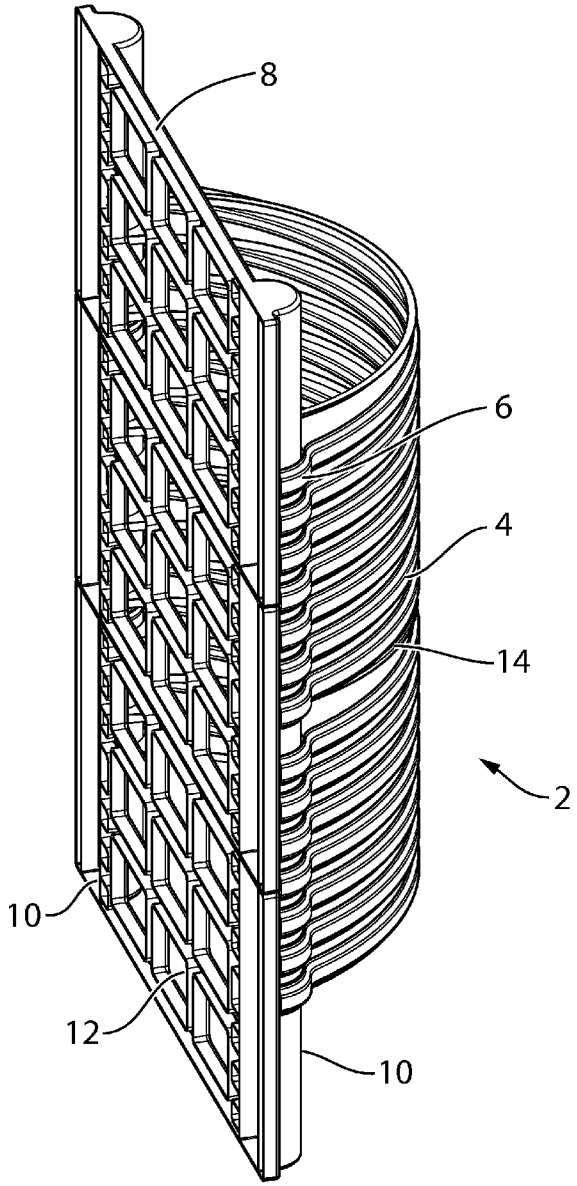
FIG. 3 illustrates an underside isometric view of the environmentally compatible modular culvert system.

Referring to FIG. 3, which shows an underside isometric view of the modular culvert system 2, the modular system comprises two adjoining corrugated arch modules 4, with cylindrical base grips 6 on each side, which rest on three adjoining base modules 8. The three base modules 8 have on each side thereof connecting base cylindrical rails 10, which together support the cylindrical base grips 6 of the overhead corrugated arch modules 4. The arch modules 4 are offset from the base modules 8 by 50 percent.

Figure 4:
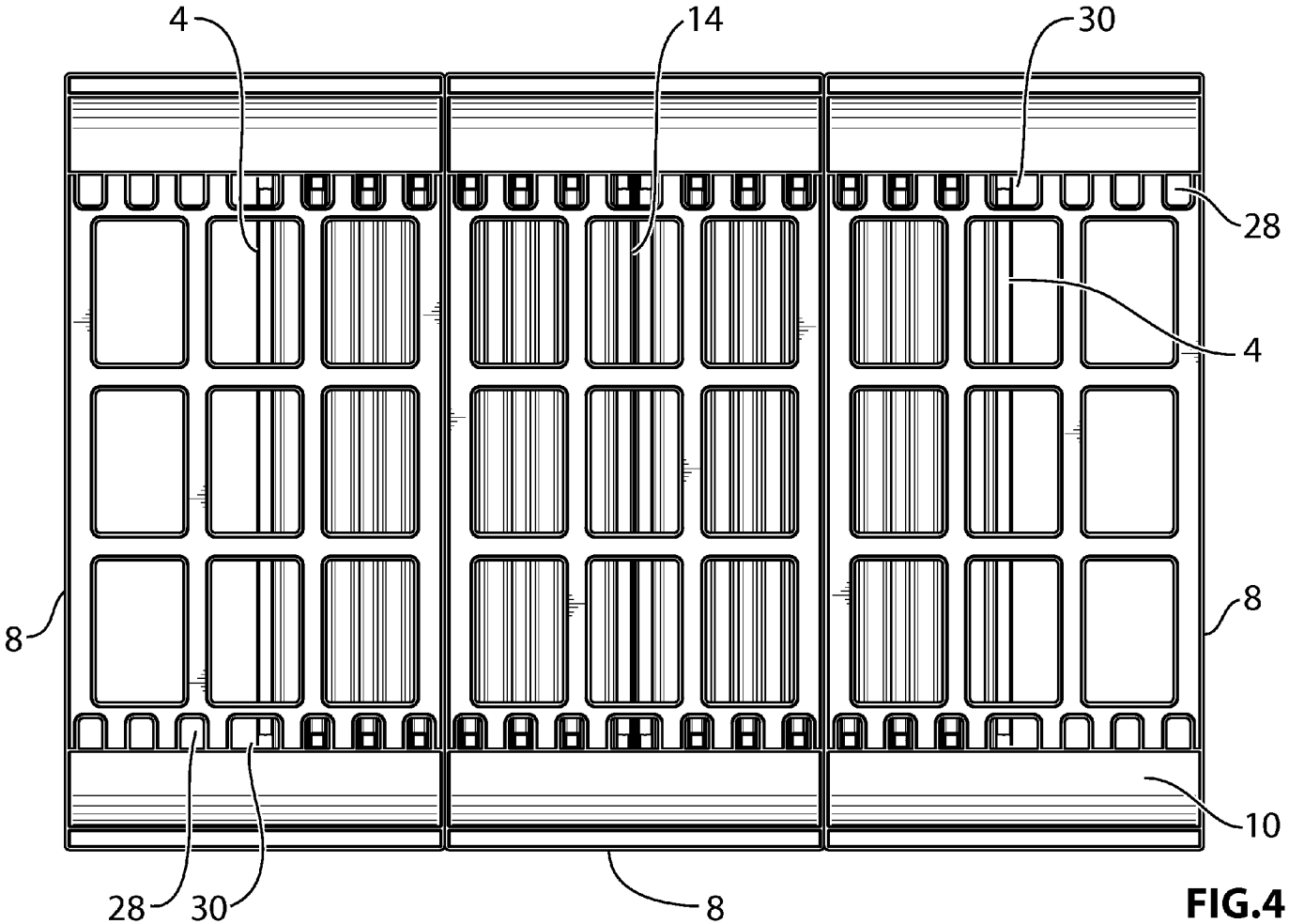
FIG. 4 illustrates a bottom view of the environmentally compatible modular culvert system.

Referring to FIG. 4, which illustrates a bottom view of the environmentally compatible modular culvert system, the modular system comprises two adjoining corrugated arch modules 4 (partially visible), which by means of cylindrical base grips 6 (not visible), rest on three adjoining base modules 8. The three base modules 8 have on each side thereof a connecting base cylindrical rails 10, which together support the cylindrical base grip portions 6 of the overhead corrugated arch modules 4. Plainly visible in FIG. 4 are the series of corrugated arch prong openings 28 and intermediate binder openings 30.

Figure 5:
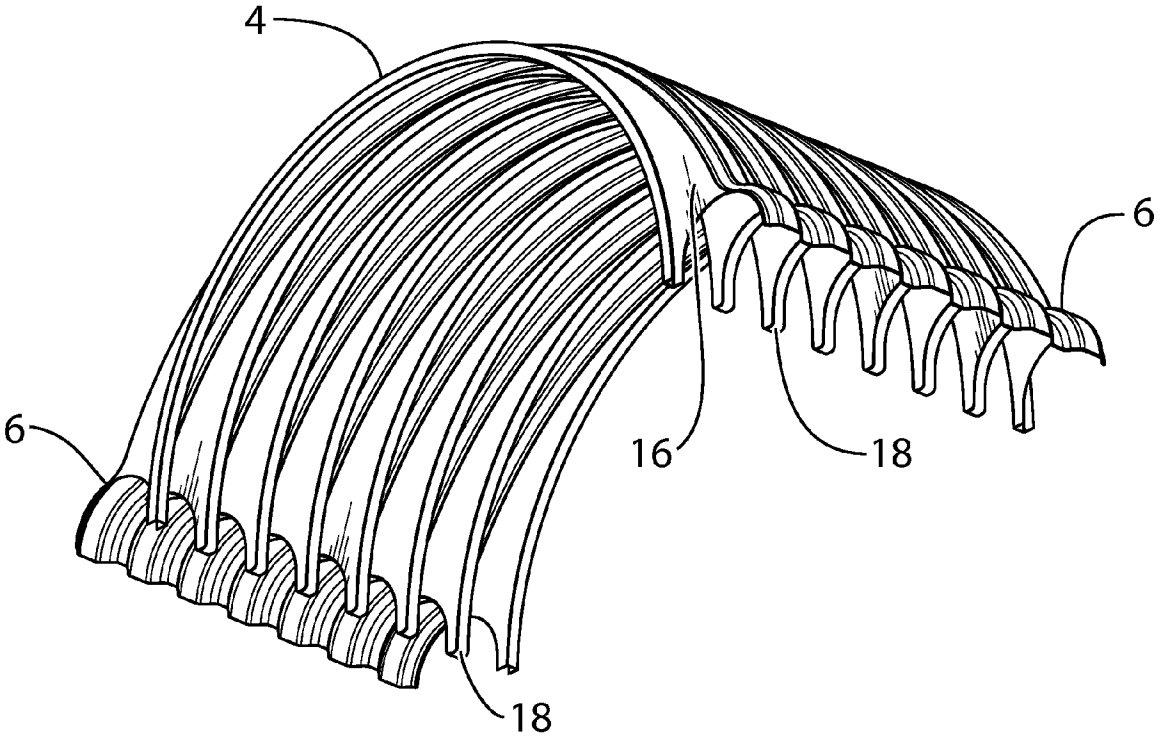
FIG. 5 illustrates an isometric view of a corrugated arch module.

Referring to FIG. 5, which illustrates a detailed isometric view of a corrugated arch module 4, the module 4 has a pair of hollow cylindrical base grips 6 on each side of the base region of the corrugated body portion of the arch module 4. It will be noted that the lower portions of the edge flanges 16 of the corrugated arch 4 have proportionally greater depth than the depth of the corrugations at the top of the arch module. This design provides greater strength to each side of the base regions of the arch module 4. Also, the interiors of the hollow cylindrical grips 6 have a series of prongs 18. These spatially arranged series of prongs 18 engage with corresponding openings 28 (see FIG. 4) in the base module 8, which will be discussed later. The corrugations above the grips 6 on each side act as baffles to reduce water flow velocity thereby enhancing the passage of fish, such as salmon, through the culvert.

Figure 6:
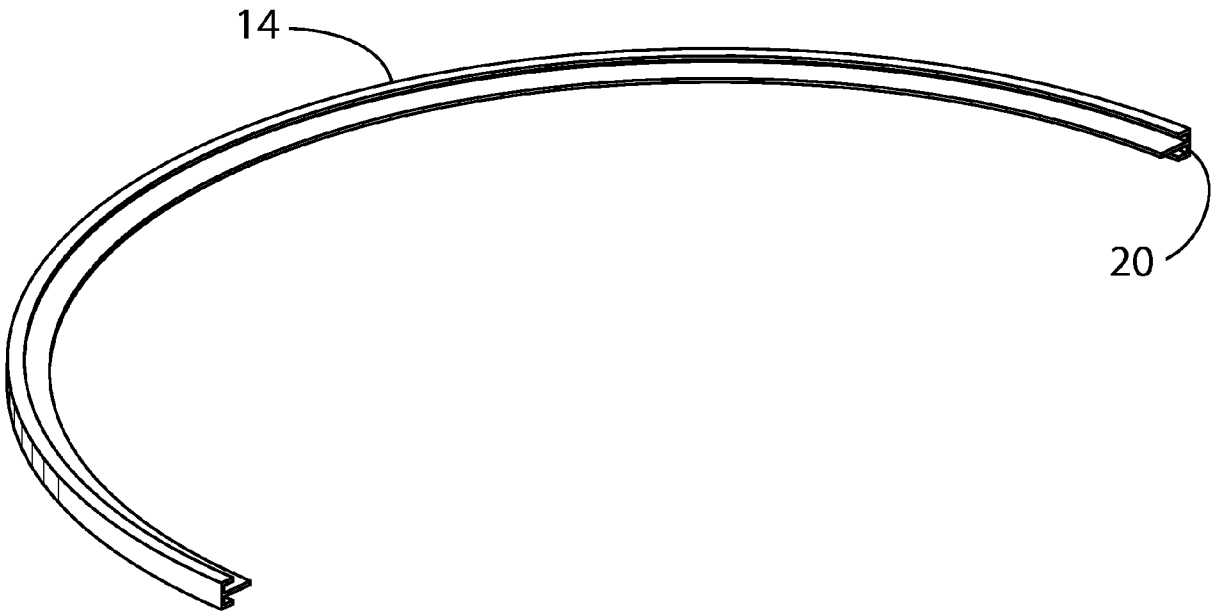
FIG. 6 illustrates an isometric view of a binder module.

FIG. 6 illustrates an isometric view of an arched binder module 14, with T-shaped cross-section 20. The arched binder 14 has the same degree of curvature as the corrugated arch module 4.

Figure 7:
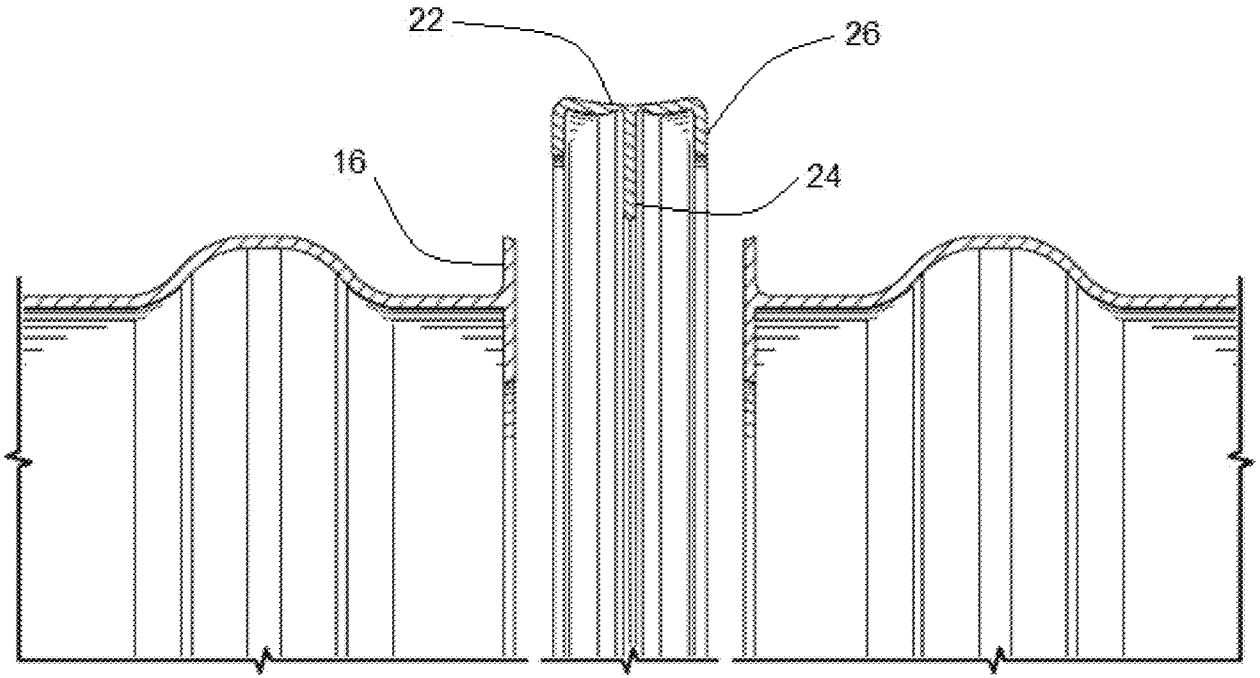
FIG. 7 illustrates a cross-section exploded view of a binder module positioned between adjoining edges of two corrugated arch modules.

FIG. 7 illustrates a detailed exploded section view of a binder module 14 between two corrugated arch modules 4. FIG. 7 illustrates in particular the T-shaped cross-section 20 of the arched binder 14, specifically the horizontal top bar portion 22, the main vertical stem 24 and the pair of arch engaging flanges 26 at each end of the top bar 22.

Figure 8:
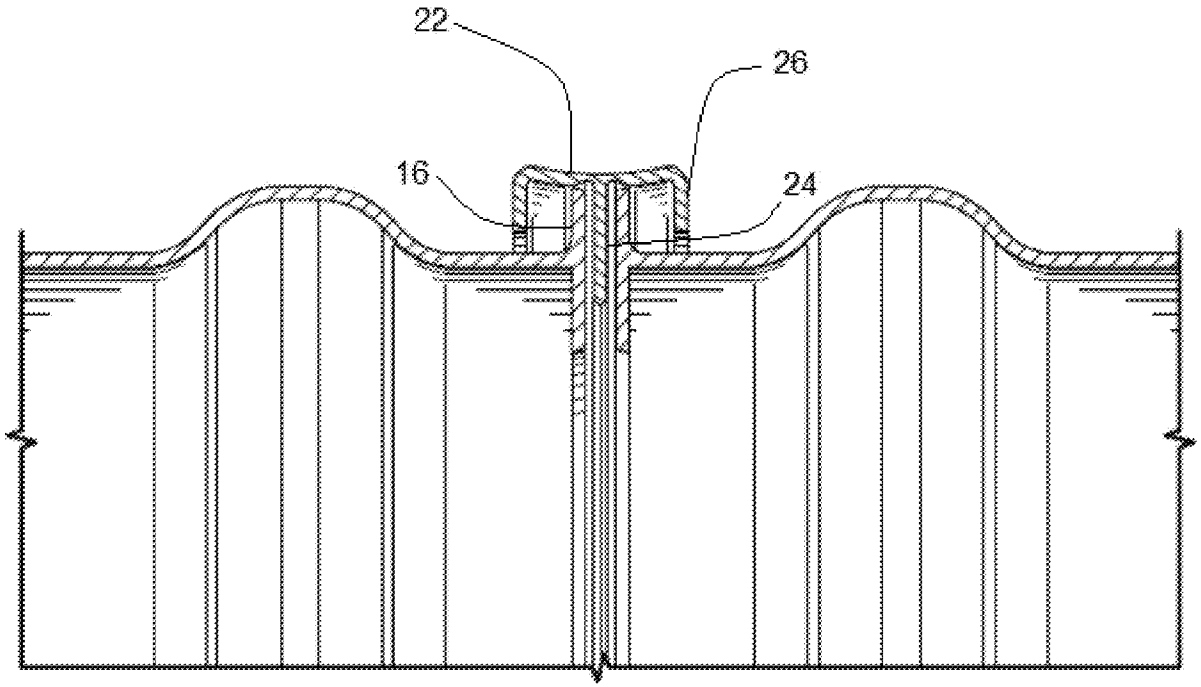
FIG. 8 illustrates a cross-section view of a binder module fitted between the edges of two corrugated arch modules.

FIG. 8 illustrates a cross-section view of a binder module 14 fitted between two corrugated arch modules 4. FIG. 8 illustrates in particular how the T-shaped cross-section of the arched binder 14, specifically the horizontal top bar portion 22, the main vertical stem 24 and the pair of arch engaging flanges 26 at each end of the top bar 22, engage the adjoining flanges 16 of the adjacent arch modules 4. As can be seen, the long stem 24 and the spaces between the stem 24 and the flanges 26 provide a significant amount of tolerance with the adjoining flanges 16 to accommodate uneven and off-level terrain. The joining system also has the advantage that no bolts or other connecting fixtures are required to enable arch modules to be movably connected together.

Figure 9:
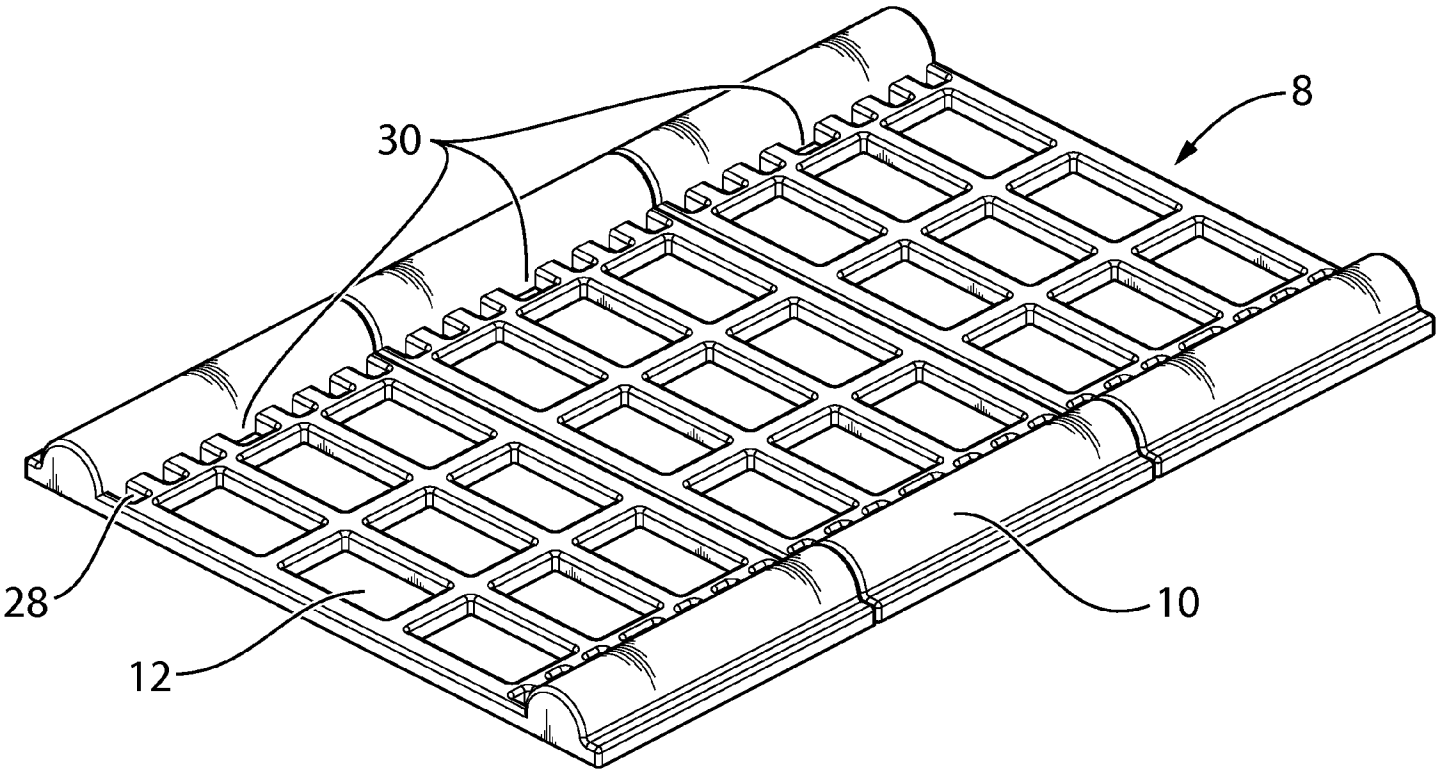
FIG. 9 illustrates an isometric view of three adjoining base modules.

FIG. 9 illustrates an isometric view of a trio of adjoining base modules 8. This view illustrates in particular the series of prong openings 28 which are located at the interior sides of the two side rails 10. These series of openings 28 are adapted to receive and hold the series of prongs 18 of the corrugated arch modules 4 (see FIG. 5). The sides of the bars making up the grid-like openings 12 in the base module 8 are upwardly tapered so that when freezing conditions exist, and ice forms in the openings 12, the ice force will not break the ribs of the base module 8 but will expand upwardly similar to a conventional ice cube tray. Located on each side in the mid-area of each base module 8, on the interior sides of the two rails 10, is a binder opening 30, which is wider than the neighboring prong openings 28. These openings 30 are adapted to receive the T-shaped ends of the binder module 14 as seen in FIGS. 1, 3 and 4. When assembled, the corrugated arch modules 4 will be deployed on the trio of base grid modules but offset by 50 percent as seen in FIG. 1. In this way, there are no joints between adjacent arch and base modules that extend in a location around the circumference of the modular culvert system 2. This arrangement provides strength for the overall culvert system 2.

Figure 10:
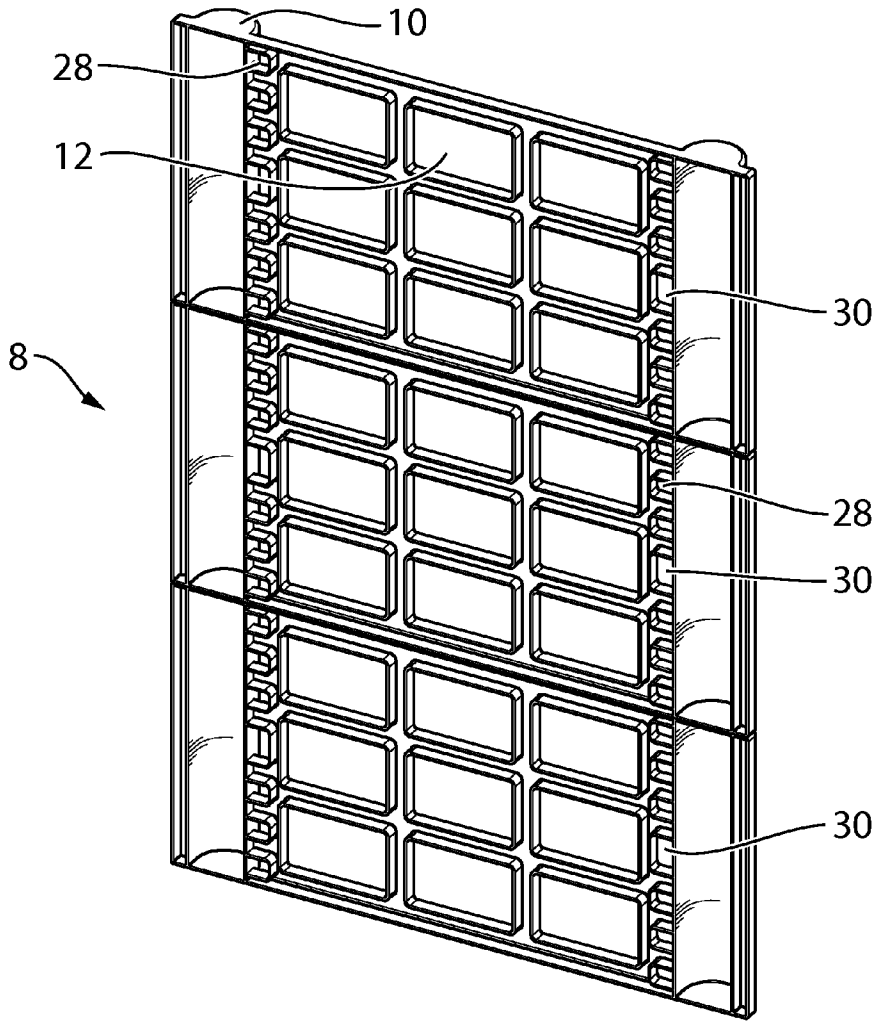
FIG. 10 illustrates an underside isometric view of three adjoining base modules.

FIG. 10 illustrates an underside isometric view of a trio of base modules 8. This view illustrates in particular the series of prong openings 28 which are adapted to receive the series of prongs 18 of the corrugated arch modules 4. FIG. 10 also illustrates the intermediate binder openings 30 which are adapted to receive the ends of the binder module 14.

Figure 11:
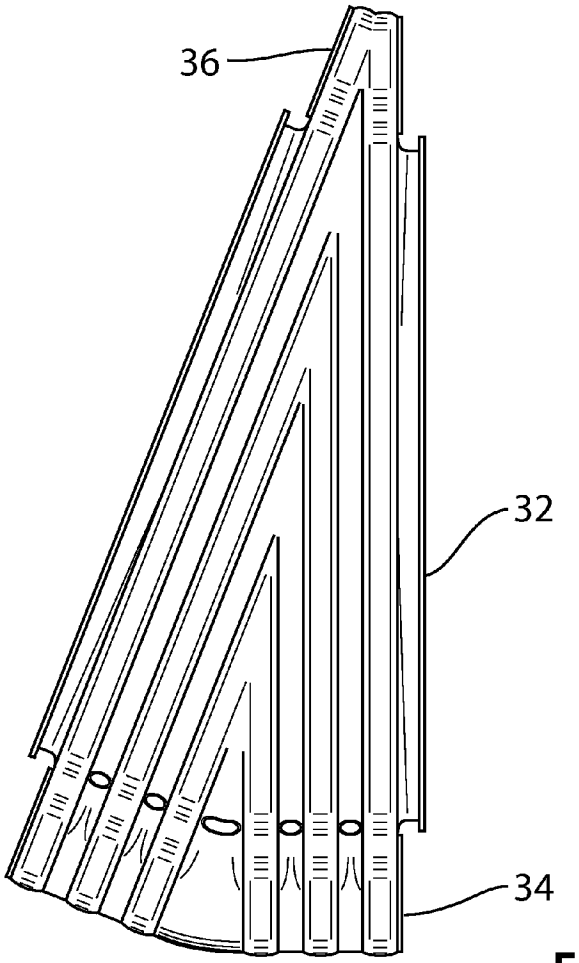
FIG. 11 illustrates a plan view of a wedge-shaped arch module.

FIG. 11 illustrates a plan view of a wedge-shaped corrugated arch module 32, with a wide cylindrical base grip 34 at one end and a narrow base grip 36. This module 32 can be used to connect adjoining corrugated arch modules 4 when it is necessary to deploy the modular culvert system in a curved relationship rather than a linear relationship.

Figure 12:
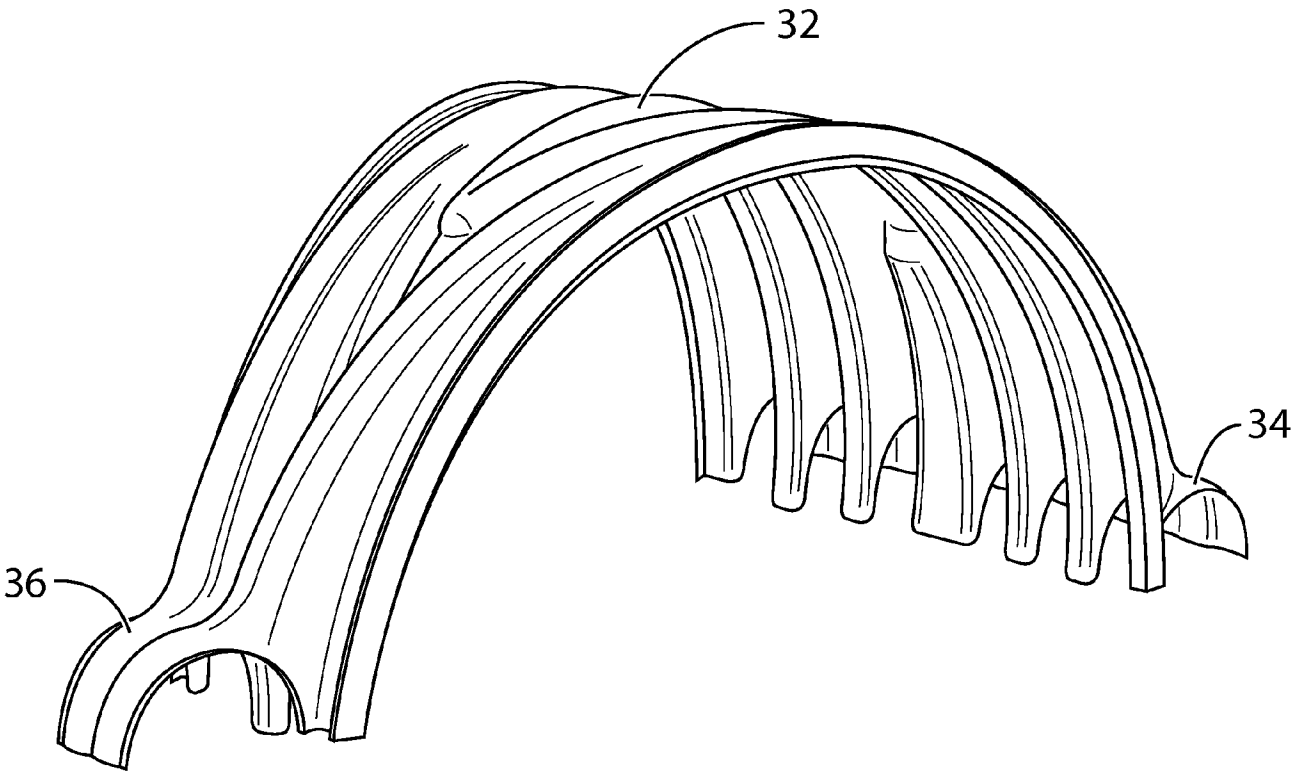
FIG. 12 illustrates an isometric view of a wedge-shaped arch module.

FIG. 12 illustrates an isometric view of a wedge-shaped arch module 32. The wide base grip 34 and the narrow base grip 36 are plainly visible. The shape of the wedge module can be varied to accommodate different angles.

The corrugated arch modules, base modules and binders can be formed from appropriate polymers using reaction injection molded technology. The polymerizing reaction is exothermic so no mold heating is required. The inventors have found that Metton™ Resin, which is available from Metton American Inc. of La Porte, Tex., is very strong, readily reaction injection-molded and is environmentally compatible. Metton LMR provides part design freedom with integrated functionality and part consolidation opportunities similar to injection molding for replacement of traditional materials such as wood and metal. The molded Metton™ resin is stronger than fibreglass, thereby permitting thinner sections, and modules can be produced from the mold at 400° F. every three to four minutes. This is a much faster production rate than fibreglass, which is labor intensive and produces two to three modules per day. The Metton™ resin is environmentally friendly and does not leach harmful ingredients into the ground water. On incineration, about one third fewer pollutants are generated than for conventional incinerated polymers.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

What is claimed is:

1. A culvert system comprising:

(a) at least one base grid module comprising two side regions, each of the side regions comprising a rail;

(b) at least one corrugated arch module resting on the base grid module, the corrugated arch module comprising two base regions, each of the base regions comprising a grip for supportive and releasable engagement by a corresponding one of the rails of the base grid module wherein depths of grooves of corrugations in the corrugated arch module deepen from a top center region to each of the grips of the base regions.

2. A system as claimed in claim 1 comprising at least two of the corrugated arch modules and an arched binder module for connecting the two corrugated arch modules.

3. A system as claimed in claim 2 wherein the arched binder module comprises a T-shaped cross-section.

4. A system as claimed in claim 2 comprising:

at least three base grid modules adjacent one another;

at least two corrugated arch modules adjacent one another and offset 50 percent from the three base grid modules, and wherein the arched binder module fits between th two adjacent corrugated arch modules and releasably connects them together.

5. A system as claimed in claim 1 wherein the base grid module comprises a plurality of spatial openings at each of the side regions and wherein the corrugated arch module comprises a plurality of protrusions at each of the base regions for supportive engagement by corresponding spatial openings of the grid module.

6. A system as claimed in claim 1 wherein the rail is formed in the shape of a semi-cylinder.

7. A system as claimed in claim 6 wherein the grip is formed in the shape of a hollow semi-cylinder.

* * * * *

UNITED STATES PATENT AND TRADEMARK OFFICE

CERTIFICATE OF CORRECTION

PATENT NO. : 8,596,910 B2
APPLICATION NO. : 12/529168
DATED : December 3, 2013
INVENTOR(S) : Robert A. Semotiuk, Ronald W. Hammerstedt and Michael D. Rae It is certified that error appears in the above-identified patent and that said Letters Patent is hereby corrected as shown below:

On the Title Page, (73) Assignees is corrected as follows:

--(73) Assignees: ~~Robert A. Semotiuk~~ Brian Semotiuk, Prince George (CA); Ronald W. Hammerstedt, McBride (CA); Michael D. Rae, Campbell River (CA)--.

Signed and Sealed this
Second Day of September, 2014

Michelle K. Lee

Michelle K. Lee
*Deputy Director of the United States Patent and Trademark Office*